US009611614B2

(12) United States Patent
Shiono et al.

(10) Patent No.: US 9,611,614 B2
(45) Date of Patent: Apr. 4, 2017

(54) WATERPROOFING METHOD FOR OUTDOOR TANK

(71) Applicant: SHIN-ETSU CHEMICAL CO., LTD., Tokyo (JP)

(72) Inventors: Yoshiyuki Shiono, Annaka (JP); Akihiro Endo, Annaka (JP); Takao Uno, Annaka (JP); Takeshi Nakajima, Tokyo (JP); Hisaharu Yamaguchi, Annaka (JP); Masahiro Yoda, Annaka (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 60 days.

(21) Appl. No.: 14/431,847

(22) PCT Filed: Aug. 19, 2013

(86) PCT No.: PCT/JP2013/072082
§ 371 (c)(1),
(2) Date: Mar. 27, 2015

(87) PCT Pub. No.: WO2014/050356
PCT Pub. Date: Apr. 3, 2014

(65) Prior Publication Data

US 2015/0233082 A1 Aug. 20, 2015

(30) Foreign Application Priority Data

Sep. 28, 2012 (JP) ..... 2012-216714

(51) Int. Cl.
*E04B 1/64* (2006.01)
*E04F 13/072* (2006.01)
(Continued)

(52) U.S. Cl.
CPC ..... *E02D 31/004* (2013.01); *E02D 27/38* (2013.01); *E02D 31/02* (2013.01); *E02D 31/025* (2013.01); *E04H 7/00* (2013.01)

(58) Field of Classification Search
USPC ..... 156/71
See application file for complete search history.

(56) References Cited

U.S. PATENT DOCUMENTS

2006/0008662 A1 1/2006 Arai et al.
2006/0059825 A1* 3/2006 Wiercinski ..... C09J 5/00 52/506.01
(Continued)

FOREIGN PATENT DOCUMENTS

CN 102732173 A 10/2012
JP 56-64978 A 6/1981
(Continued)

OTHER PUBLICATIONS

Machine translation of JP 56-64978 (Jul. 20, 2016).*
(Continued)

*Primary Examiner* — Sing P Chan
(74) *Attorney, Agent, or Firm* — Birch, Stewart, Kolasch & Birch, LLP

(57) ABSTRACT

The present invention relates to a waterproofing method for an outdoor tank, the waterproofing method being characterized in that the boundary portion between the bottom of the outdoor tank installed on a foundation and the foundation is covered in a liquid tight manner by a waterproof sheet adhered so as to extend from the outdoor tank to the foundation. The present invention can provide a waterproofing method which is effective to prevent the entry of rain water into the boundary portions between the bottoms of outdoor tanks and the foundations, most of the outdoor tanks being large tanks mainly installed in oil refineries or the like. This waterproofing method for an outdoor tank can more
(Continued)

reliably waterproof the bottom side of the outdoor tank using the simple method.

3 Claims, 3 Drawing Sheets

(51) Int. Cl.

| | |
|---|---|
| ***E04F 13/073*** | (2006.01) |
| ***E02D 31/00*** | (2006.01) |
| ***E04H 7/00*** | (2006.01) |
| ***E02D 27/38*** | (2006.01) |
| ***E02D 31/02*** | (2006.01) |

(56) References Cited

U.S. PATENT DOCUMENTS

| | | | | |
|---|---|---|---|---|
| 2006/0079645 | A1 | 4/2006 | Hasegawa et al. | |
| 2011/0278302 | A1* | 11/2011 | Van Fossen | B29C 65/5028 220/495.01 |
| 2012/0219835 | A1* | 8/2012 | Kawabe | C09J 7/0246 429/94 |
| 2012/0247033 | A1 | 10/2012 | Nakajima et al. | |

FOREIGN PATENT DOCUMENTS

| | | | | |
|---|---|---|---|---|
| JP | 58-11689 | A | | 1/1983 |
| JP | 58-99380 | A | | 6/1983 |
| JP | 8-198384 | A | | 8/1996 |
| JP | 2000-273419 | A | | 10/2000 |
| JP | 2000-320085 | A | | 11/2000 |
| JP | 3580887 | B2 | | 10/2004 |
| JP | 2006-52384 | A | | 2/2006 |
| JP | 4076673 | B2 | | 4/2008 |
| JP | 2008-231812 | A | | 10/2008 |
| JP | 3166787 | U | * | 3/2011 |
| JP | 2012-153129 | A | | 8/2012 |
| JP | 2012-215057 | A | | 11/2012 |

OTHER PUBLICATIONS

English Abstract of JP 3166787 (Sep. 22, 2016).*
Machine translation of JP 3166787 (Sep. 22, 2016).*
International Search Report issued in PCT/JP2013/072082, mailed on Sep. 10, 2013.
Office Action issued May 31, 2016, in Chinese Patent Application No. 201380050537.2.
Office Action issued Sep. 1, 2015, in Japanese Patent Application No. 2012-216714.
Written Opinion issued Aug. 18, 2016, in Singapore Application No. 11201502474T.

* cited by examiner

WATERPROOFING METHOD FOR OUTDOOR TANK

TECHNICAL FIELD

This invention relates to a method for the waterproof treatment of an outdoor tank, typically a large volume tank as often installed in oil refinery plants or the like, which method is effective for preventing rainwater from entering the boundary region between the bottom side of the tank and the foundation.

BACKGROUND ART

In conjunction with an outdoor tank, typically a large volume tank as often installed in oil refinery plants or the like, one problem known from the past is that rainwater enters the boundary region between the bottom side of the tank and the foundation. The problem is addressed by covering the boundary region between the bottom side of the large tank and the foundation with a pressure-sensitive adhesive butyl-based rubber sheet for preventing the entry of rainwater. However, since the PSA butyl-based rubber sheet is poor in weather resistance, heat resistance and freeze resistance, it fails to prevent the entry of rainwater over a long period of time, allowing rust generation at the bottom of the outdoor tank, with potential tank failure.

For example, Patent Document 1 (JP 3580887) describes a cover member comprising a sealant layer having salt barrier and waterproof properties, a protective layer, and a cover layer stacked. On use, it fails to prevent the entry of rainwater over a long period of time, and sometimes rust generates at the bottom of the outdoor tank.

Also Patent Document 2 (JP 4076673) describes a sealing member having a fold, made of vulcanized EPDM base rubber or unvulcanized rubber base butyl rubber. On use, it fails to prevent the entry of rainwater over a long period of time, and sometimes rust generates at the bottom of the outdoor tank.

SUMMARY OF INVENTION

Technical Problem

An object of the invention, which has been made under the above circumstances, is to provide a method for the waterproof treatment of an outdoor tank, which method is effective for preventing the entry of rainwater over a long period of time, inhibiting rusting at the bottom of the outdoor tank, and preventing tank failure.

Solution to Problem

Making extensive investigations to attain the above object, the inventors have found that only studies on the material and shape of a waterproof sheet are insufficient, and the treatment method is important, and that not only coverage of an outdoor tank with the waterproof sheet and coverage of a foundation with the waterproof sheet are important, but also complete coverage of a boundary region between the outdoor tank and the foundation with the waterproof sheet is important, and in particular, complete coverage of an outer periphery of the waterproof sheet with a sealant is important, especially at the initial stage of treatment.

The above object is attained by the invention which provides a method for the waterproof treatment of an outdoor tank as defined below.

[1] A method of waterproof treating an outdoor tank installed on a foundation, a boundary region being defined between the bottom of the outdoor tank and the foundation, the method comprising the step of attaching a waterproof sheet across the boundary region so as to extend from the outdoor tank to the foundation for thereby forming a liquid tight cover to the boundary region.

[2] The waterproofing method of [1] wherein a plurality of waterproof sheets are juxtaposed to form a liquid tight cover to the boundary region and liquid-tightly overlapped to define an overlap between adjacent waterproof sheets, the overlap having a width of at least 5 mm.

[3] The waterproofing method of [1] or [2] wherein the waterproof sheet is pressure-sensitive adhesive on at least one surface, and the waterproof sheet is attached such that the pressure-sensitive adhesive surface may extend across the boundary region from the outdoor tank to the foundation.

[4] The waterproofing method of [3] wherein the one surface of the waterproof sheet has a bond strength of 0.5 to 10 N/25 mm relative to the outdoor tank and 0.5 to 10 N/25 mm relative to the foundation.

[5] The waterproofing method of any one of [1] to [4] wherein the waterproof sheet is directly attached to the outdoor tank and the foundation without any primer.

[6] The waterproofing method of any one of [1] to [5] wherein the waterproof sheet is formed of silicone.

[7] The waterproofing method of any one of [1] to [6] wherein the foundation is made of concrete, mortar, asphalt concrete, asphalt mortar, or asphalt sand.

[8] The waterproofing method of any one of [1] to [7], further comprising the step of applying a sealant to a tank side edge portion and a foundation side edge portion of the waterproof sheet.

[9] The waterproofing method of any one of [1] to [8] wherein the sealant is a silicone base sealant.

Advantageous Effects of Invention

The invention provides a method for the waterproof treatment of an outdoor tank, typically a large volume tank as often installed in oil refinery plants or the like, which method is effective for preventing rainwater from entering the boundary region between the bottom side of the tank and the foundation. The method for the waterproof treatment of an outdoor tank ensures to waterproof the bottom side of the outdoor tank in a simple treatment way.

DESCRIPTION OF EMBODIMENTS

The present invention relates to a method for the waterproof treatment of an outdoor tank made of steel or the like and installed on a foundation and aims to prevent rainwater from entering the boundary region between the bottom side of the outdoor tank and the foundation. With the method, a waterproof sheet is attached and arranged across the boundary region so as to extend from the outdoor tank to the foundation for thereby establishing a liquid tight coverage over the boundary region with the waterproof sheet.

Figure 1:
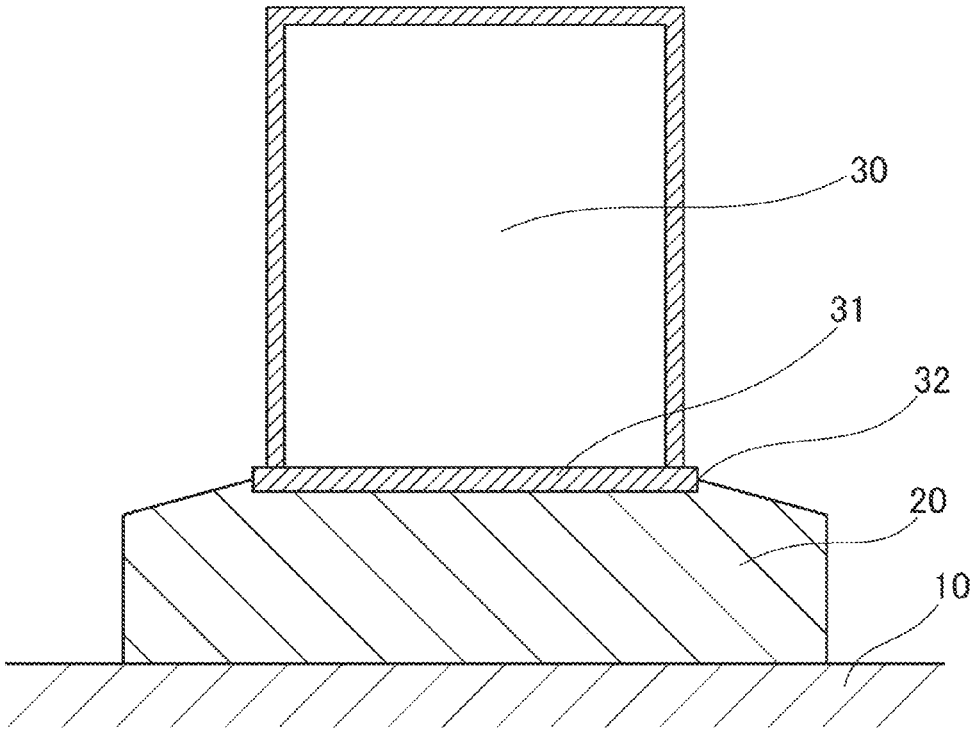
FIG. 1 is a schematic cross-sectional view showing the installation of an outdoor tank.

Referring to FIG. 1, one embodiment of the method is described. FIG. 1 illustrates an outdoor tank 30 installed on and supported by a foundation 20, the tank being filled with contents such as oils, asphalt or gases. The outdoor tank 30 is typically cylindrical, sized to a diameter of 10 to 80 meters and a height of 10 to 50 meters, and installed on the foundation 20 as described above. In FIG. 1, 10 depicts the ground. The bottom of the outdoor tank 30 is constructed by an annular plate 31, and the boundary region between the outdoor tank and the foundation is specifically a boundary region 32 between the annular plate 31 and the foundation 20. Described below is one embodiment of the method for preventing rainwater from entering the boundary region 32 for thereby inhibiting rust generation at the tank bottom and tank failure.

Figure 2:
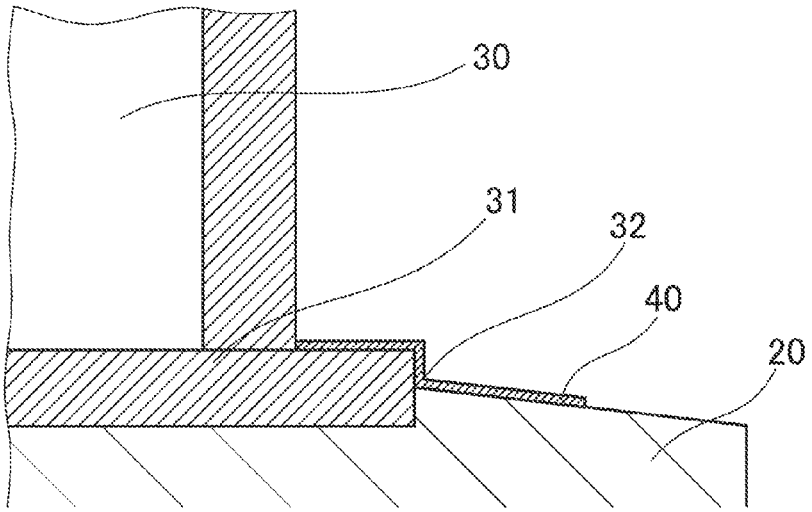
FIG. 2 is a partially cutaway cross-sectional view showing one embodiment of the waterproofing method of the invention.
Figure 3:
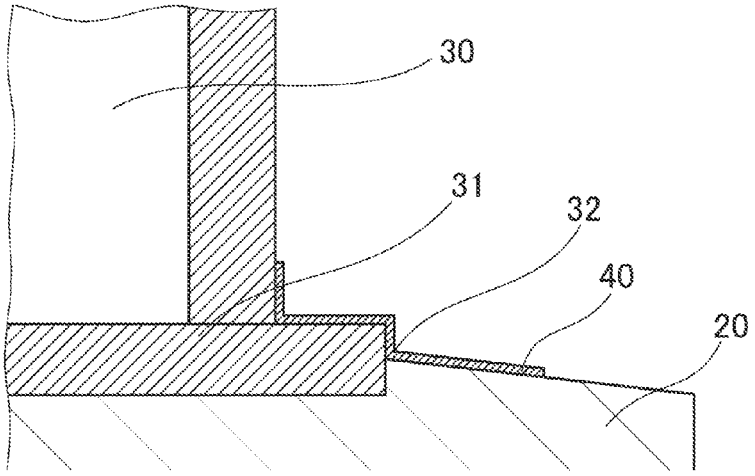
FIG. 3 is a partially cutaway cross-sectional view showing another embodiment of the waterproofing method of the invention.

As long as the boundary region between the outdoor tank and the foundation is completely covered with a waterproof sheet without leaving any portions uncovered, it becomes possible to prevent entry of rainwater over a long period of time, inhibiting rust from generating at the tank bottom, i.e., annular plate and preventing tank failure. Referring to FIG. 2, one embodiment of coverage of the boundary region with the waterproof sheet is described. A waterproof sheet 40 is attached so as to cover the boundary region 32 between the foundation 20 and the annular plate 31. As shown in FIG. 3, the waterproof sheet 40 may be attached so as to cover even the side wall of the outdoor tank.

Figure 4A:
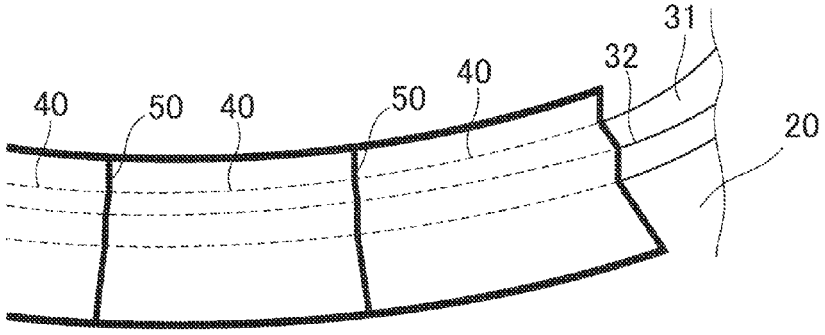
FIG. 4 shows a further embodiment of the water-proofing method of the invention, (A) being a partially cutaway plan view of waterproof sheets disposed to cover the outdoor tank, foundation and boundary region therebetween and (B) being a cross-sectional view of an overlap between waterproof sheets.
Figure 4B:
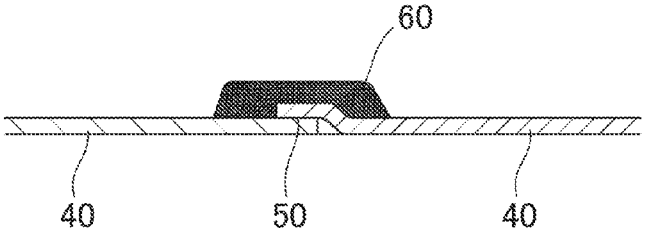

In most cases, a plurality of waterproof sheets are used. They are juxtaposed along the boundary region so that the entire boundary region is covered with the waterproof sheets. The area which may be readily exposed externally in the boundary region between the outdoor tank and the foundation is the interface between adjacent waterproof sheets. Referring to FIG. 4, adjacent waterproof sheets are preferably overlapped. The overlap 50 between adjacent waterproof sheets preferably has a width of at least 5 mm, more preferably at least 10 mm, and even more preferably at least 20 mm. If the width of the overlap between adjacent waterproof sheets is less than 5 mm, peel may occur during the treatment, failing in complete coverage of the boundary region 32, with potential entry of rainwater. If the width of the overlap between adjacent waterproof sheets is greater, for example, 50 mm or more, then the number of waterproof sheets necessary to cover the boundary region 32 entirely becomes larger, leading to an increased cost.

The preferred waterproof sheet 40 used in the treatment is a waterproof sheet which is pressure-sensitive adhesive on at least one surface to come in contact with the foundation 20 and annular plate 31. This sheet ensures to prevent rainwater from entering the boundary region 32.

Figure 5:
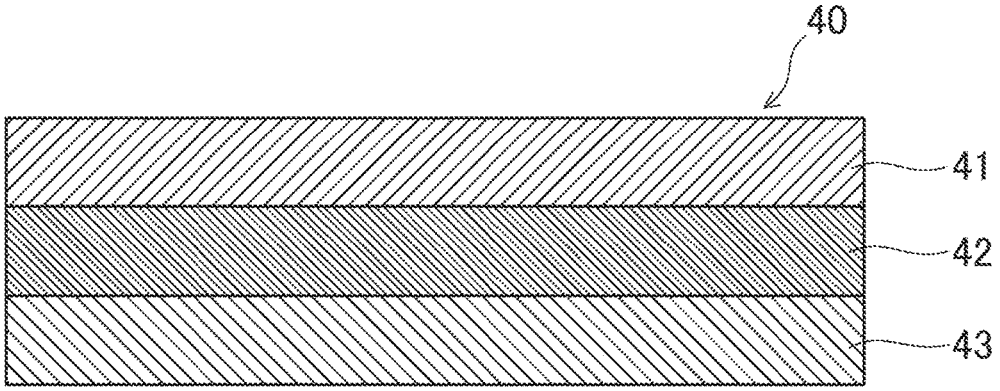
FIG. 5 is a cross-sectional view of one exemplary waterproof sheet according to the invention.

Referring to FIG. 5, one example of the waterproof sheet is illustrated as comprising a rubber base 41 and a pressure-sensitive adhesive (PSA) layer 42 stacked on one surface thereof. Typically a cover film 43 is releasably attached onto the PSA layer 42. Upon treatment, the cover film 43 is released before the sheet is attached such that the PSA layer 42 is in contact with the foundation 20 and the annular plate 31.

The waterproof sheet 40 used herein is preferably based on silicone having weather resistance, heat resistance and freeze resistance. In the example of FIG. 5, the rubber base 41 is preferably made of silicone rubber. The silicone rubber is not particularly limited, and any of silicone rubbers obtained from curing of prior art well-known silicone rubber compositions may be used. The PSA layer 42 is preferably made of a silicone resin or silicone gel having pressure-sensitive adhesive properties. While the foundation 20 may be any of concrete, mortar, asphalt concrete, and asphalt mortar, or a combination thereof, the waterproof sheet 40 which is compatible with the foundation 20 is preferably used for the treatment.

For the treatment where the waterproof sheet having a PSA layer on at least one surface is attached to the foundation and the annular plate or outdoor tank, the waterproof sheet preferably has on the at least one surface a bond strength of 0.5 to 10 N/25 mm between the outdoor tank and the waterproof sheet and 0.5 to 10 N/25 mm between the foundation and the waterproof sheet. Use of the waterproof sheet having a bond strength in the range can prevent penetration of rainwater through the interface between the outdoor tank and the waterproof sheet and the interface between the foundation and the waterproof sheet over a long period of time. If the bond strength is below the range, peel may often occur, and rainwater may penetrate through the peeled areas. If the bond strength is above the range, partial re-attaching operation necessary to cover the boundary region completely during constructive treatment may become difficult, taking a longer treatment time. If the bond strength is further higher, re-attaching operation is impossible, failing to cover the boundary region completely.

In the treatment method of the invention, it is preferred to attach the waterproof sheet 40 which adheres to the foundation 20 and the annular plate 31 directly without a need for primer. In the environment where water droplets are condensed due to a weather temperature difference or a high moisture resulting from weather, especially rain and snow, there is the problem that the waterproof sheets cannot be attached until the treatment surface is dried. The primer-less application ability of the waterproof treatment method of the invention ensures that even when the treatment surface is wet, the sheet can be attached to the surface simply after the surface is wiped with fabrics or wastes. This leads to the epoch-making advantage that constructive treatment with waterproof sheets can be started immediately after the weather becomes good. Even when it rains during the treatment, the possibility of rainwater penetration is minimized.

Figure 6:
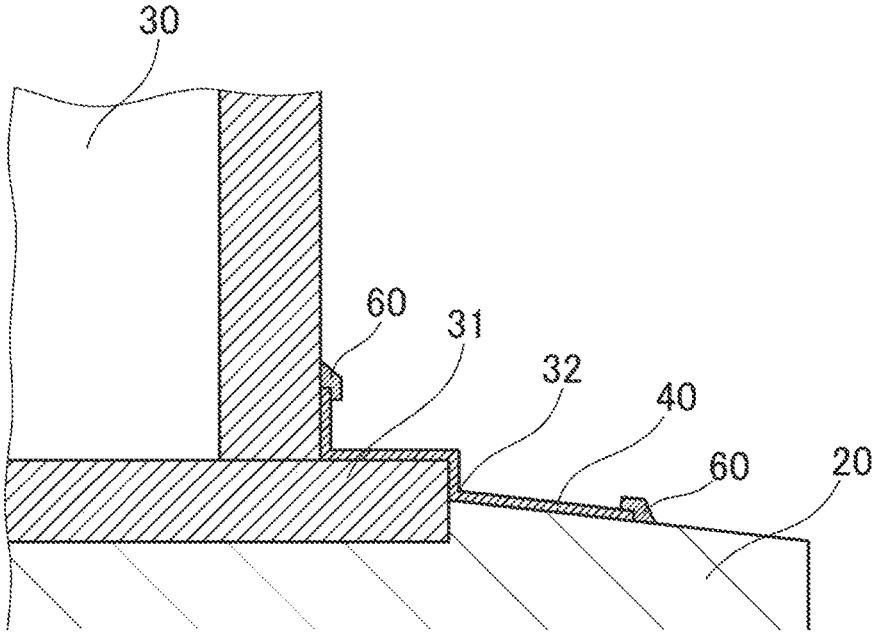
FIG. 6 is a partially cutaway cross-sectional view showing a still further embodiment of the waterproofing method of the invention wherein outer peripheries of a waterproof sheet are bonded with a sealant.

Further preferably, as shown in FIG. 6, a sealant 60 is applied to and disposed on those edges of the waterproof sheet 40 disposed adjacent to the outdoor tank 30 and the foundation 20. This ensures better waterproof treatment. It is also preferred to apply the sealant 60 so as to cover the overlaps 50.

The sealant used herein may be any of well-known silicone, polysulfide and polyurethane base sealants, with the silicone base sealants being preferred for the treatment method. As the sealant, Sealant Master 300, Sealant 70, Sealant 701 and the like, available from Shin-Etsu Chemical Co., Ltd. may be used.

EXAMPLES

Examples and Comparative Examples are given below for illustrating the invention although the invention is not limited thereto. In Examples, all parts and percents are by weight.

Example 1

A rubber base layer was formed from a dimethylsilicone rubber composition, which was prepared by providing 100 parts of a millable dimethylsilicone rubber compound KE-571-U (Shin-Etsu Chemical Co., Ltd., containing the majority of vinyl-containing dimethylpolysiloxane with a degree of polymerization of about 5,000, up to 40% of dry silica with a BET specific surface area of 200 $m^2/g$, and up to 10% of silanol-endcapped dimethylsiloxane oligomer with a molecular weight of up to 700 as a silica dispersant, the compound being free of phenyl) as a transparent uncrosslinked dimethylsilicone rubber compound, adding thereto 0.5/2.0 parts of addition or hydrosilylation reaction vulcanizing agent C-25A/B (Shin-Etsu Chemical Co., Ltd.), and milling on a two-roll mill. The composition was calendered onto an embossed PET film of 100 μm thick to form a layer of 0.7 mm thick, and continuously heat cured in a heating furnace at 140° C. for 10 minutes, obtaining a sheet having a rubber base layer disposed on PET film.

A PSA layer was formed from a PSA composition, which was prepared by feeding into an agitation mixer 75 parts of dimethylvinylsiloxy-endcapped dimethylpolysiloxane (1) having an average degree of polymerization of 1,000, and a 50% toluene solution containing 25 parts of resinous copolymer (2) which is solid at room temperature (25° C.) and consists of $(CH_2{=}CH)(CH_3)_2SiO_{1/2}$ units, $(CH_3)_3SiO_{1/2}$ units and $SiO_2$ units wherein a molar ratio $[\{(CH_2{=}CH)(CH_3)_2SiO_{1/2}+(CH_3)_3SiO_{1/2}\}/SiO_2]$ is 0.85 and a $CH_2{=}CH{-}$ content is 0.0008 mol/g, mixing the contents for 30 minutes, and fully distilling off the toluene. To 100 parts of the resulting silicone rubber base were added 0.9 part of resinous copolymer (4) composed mainly of $(CH_3)_2HSiO_{1/2}$ units and $SiO_2$ units and having SiH groups, with a SiH content of 0.0090 mol/g as a crosslinker and 0.05 part of ethynyl cyclohexanol as a reaction regulator. Agitation was continued for 15 minutes. The resulting silicone rubber composition was combined with 0.1 part of a platinum catalyst (Pt concentration 1%), yielding the PSA composition.

The PSA composition was coated on the rubber base layer to a thickness of 1.0 mm using a comma coater, and heat cured in a heating furnace at 140° C. for 10 minutes, yielding a two-layer cured laminate sheet. The rubber base had a JIS A hardness of 70, and the PSA layer had an Asker C hardness of 15. A PE cover film was laid on the surface of the PSA layer, obtaining a waterproof sheet laminate.

The rubber base-adjacent PET film and the PSA layer-adjacent PE film were peeled from the sheet laminate, leaving a waterproof sheet which was evaluated by several tests to be described later. The results are shown in Table 1.

In a waterproof test, a plurality of waterproof sheets of 300 mm by 1,000 mm, obtained as above, were sequentially attached across the boundary region between an outdoor tank and a foundation such that the overlap between two adjacent waterproof sheets might have a distance of 25 mm. Sealant Master 300 was applied as the sealant to bury the outer peripheries of the waterproof sheets over a distance of 20 mm.

Example 2

As in Example 1, a sheet having a rubber base layer of 0.7 mm thick disposed on a PET film was obtained.

A PSA layer was formed from a PSA composition, which was prepared by feeding into an agitation mixer 70 parts of dimethylvinylsiloxy-endcapped dimethylpolysiloxane (1) having an average degree of polymerization of 450, and a 50% toluene solution containing 30 parts of resinous copolymer (2) which is solid at room temperature (25° C.) and consists of $(CH_2{=}CH)(CH_3)_2SiO_{1/2}$ units, $(CH_3)_3SiO_{1/2}$ units and $SiO_2$ units wherein a molar ratio $[\{(CH_2{=}CH)(CH_3)_2SiO_{1/2}+(CH_3)_3SiO_{1/2}\}/SiO_2]$ is 0.85 and a $CH_2{=}CH{-}$ content is 0.0008 mol/g, mixing the contents for 30 minutes, and fully distilling off the toluene. To 100 parts of the resulting silicone rubber base were added 3.0 part of methylhydrogenpolysiloxane (5) having a SiH group on side chain (i.e., on a siloxane unit midway the molecular chain) having a degree of polymerization of 60 and a SiH content of 0.0055 mol/g as a crosslinker and 0.05 part of ethynyl cyclohexanol as a reaction regulator. Agitation was continued for 15 minutes. The resulting silicone rubber composition was combined with 0.1 part of platinum catalyst (Pt concentration 1%), yielding the PSA composition.

As in Example 1, a waterproof sheet laminate was obtained. The PSA layer had an Asker C hardness of 30.

The rubber base-adjacent PET film and the PSA layer-adjacent PE film were peeled from the laminate, leaving a waterproof sheet which was evaluated as in Example 1. The results are shown in Table 1.

Example 3

As in Example 1, a sheet having a rubber base layer of 0.7 mm thick disposed on a PET film was obtained.

A PSA layer was formed from a PSA composition, which was prepared by feeding into a planetary mixer 60 parts of dimethylvinylsiloxy-endcapped dimethylpolysiloxane (1) having an average degree of polymerization of 300, 40 parts of resinous copolymer (3) which is solid at room temperature (25° C.) and consists of $(CH_3)_3SiO_{1/2}$ units and $SiO_2$ units wherein a molar ratio $[(CH_3)_3SiO_{1/2}/SiO_2]$ is 0.75, and 8 parts of hydrophobized fumed silica having a BET specific surface area of 110 $m^2/g$ (R-972 by Nippon Aerosil Co., Ltd.) as finely divided silica, mixing the contents for 30 minutes, and milling once on a three-roll mill. To 100 parts of the resulting silicone rubber base were added 0.99 part of methylhydrogenpolysiloxane (5) having a SiH group on side chain (i.e., on a siloxane unit midway the molecular chain) with a degree of polymerization of 20 and a SiH content of 0.0060 mol/g as a crosslinker and 0.05 part of ethynyl cyclohexanol as a reaction regulator. Agitation was continued for 15 minutes. The resulting silicone rubber composition was combined with 0.1 part of platinum catalyst (Pt concentration 1%), yielding the PSA composition.

As in Example 1, a waterproof sheet laminate was obtained. The PSA layer had an Asker C hardness of 30.

The rubber base-adjacent PET film and the PSA layer-adjacent PE film were peeled from the laminate, leaving a waterproof sheet which was evaluated as in Example 1. The results are shown in Table 1.

Example 4

The treatment and evaluation were performed as in Example 1 using the same waterproof sheets as in Example 1 except that the overlap between two adjacent waterproof sheets had a distance of 5 mm. The results are shown in Table 1.

Comparative Example 1

The treatment and evaluation were performed as in Example 1 using the same waterproof sheets as in Example 1 except that adjacent waterproof sheets were not overlapped and the boundary region between the tank and the foundation was exposed over gaps of 5 mm. The results are shown in Table 1.

[Evaluation Tests]

Pressure-Sensitive Adhesion

The waterproof sheet was cut into samples of 25 mm wide by 100 mm long. According to JIS 20237, the waterproof sheet sample was attached to a 4-mm thick plate of concrete, mortar, asphalt concrete, asphalt mortar or asphalt sand, with the PSA layer of the waterproof sheet in contact with the plate. A bond strength was measured by peeling the PSA layer from the plate at room temperature, a rate of 300 mm/min, and an angle of 180°.

Long-Term Attachment Stability

The waterproof sheet was cut into samples of 25 mm wide by 100 mm long. The waterproof sheet sample was attached to a 4-mm thick plate of concrete, with the PSA layer in contact with the plate. The assembly was stored at 50° C. and a humidity of 85% RH for one month. A bond strength was then measured by peeling the PSA layer from the concrete plate at room temperature, a rate of 300 mm/min, and an angle of 180°.

Waterproofness

Initial waterproofness was evaluated after one month of weathering from the treatment and rated OK (○) for no rainwater entry or NG (x) when rainwater entry was found.

Long-term waterproofness was evaluated after one year of weathering from the treatment and rated OK (○) for no rainwater entry or NG (x) when rainwater entry was found.

TABLE 1

| | Example 1 | Example 2 | Example 3 | Example 4 | Comparative Example 1 |
|---|---|---|---|---|---|
| Bond strength vs concrete (N/25 mm) | 4.1 | 4.3 | 4.1 | 4.2 | 4.1 |
| Bond strength vs mortar (N/25 mm) | 3.1 | 3.3 | 3.1 | 3.2 | 3.1 |
| Bond strength vs asphalt concrete (N/25 mm) | 4.6 | 4.8 | 4.6 | 4.7 | 4.6 |
| Bond strength vs asphalt mortar (N/25 mm) | 3.6 | 3.8 | 3.6 | 3.7 | 3.6 |
| Bond strength vs asphalt sand (N/25 mm) | 3.4 | 3.6 | 3.4 | 3.5 | 3.4 |
| Long-term attachment stability (N/25 mm) | 3.0 | 3.3 | 3.0 | 3.3 | 3.0 |
| Initial waterproofness | ○ | ○ | ○ | ○ | ○ |
| Long-term waterproofness | ○ | ○ | ○ | ○ | x |

REFERENCE SIGNS LIST

10 ground
20 foundation
30 outdoor tank
31 annular plate (part of outdoor tank)
32 boundary region between outdoor tank and foundation
40 waterproof sheet
41 rubber base
42 PSA layer
43 cover film
50 overlap
60 sealant

The invention claimed is:

1. A method of waterproof treating an outdoor tank installed on a foundation made of concrete, mortar, asphalt concrete, asphalt mortar, or asphalt sand, a boundary region being defined between a bottom of the outdoor tank and the foundation, the method comprising the steps of:

(a) providing to said outdoor tank a waterproof sheet comprising a rubber base made of silicone rubber and a pressure-sensitive adhesive layer made of a silicone resin or silicone gel having pressure-sensitive adhesive properties and stacked on one surface of the rubber base;

(b) attaching a plurality of said waterproof sheets across the boundary region so as to extend from the outdoor tank to the foundation for thereby forming a liquid tight cover to the boundary region, said plurality of waterproof sheets being juxtaposed to form a liquid tight cover covering said boundary region and being liquid-tightly overlapped to define an overlap between adjacent waterproof sheets, said overlap having a width of at least 5 millimeters, and said waterproof sheets being directly attached to the outdoor tank and the foundation without any primer, wherein the waterproof sheets are attached such that the pressure-sensitive adhesive surface extends across the boundary region from the outdoor tank to the foundation, the pressure-sensitive adhesive layers having a bond strength of 0.5 to 10 N/25 millimeters relative to the outdoor tank and 0.5 to 10 N/25 millimeters relative to the foundation; and (c) applying a silicone, polysulfide, or polyurethane sealant on the waterproof sheet edges adjacent to the outdoor tank, to the foundation, and to said overlaps.

2. The waterproofing method of claim 1, wherein the sealant is a silicone base sealant.

3. A method of waterproof treating a boundary region between an outdoor tank and a concrete, mortar, asphalt concrete, asphalt mortar, or asphalt sand foundation upon which said outdoor tank is installed, said method comprising:

attaching a plurality of waterproof sheets each comprising a silicone rubber base having a silicone resin or silicone gel pressure-sensitive adhesive layer stacked on one surface of the rubber base across said boundary region so as to extend from the outdoor tank to the foundation, said plurality of waterproof sheets being juxtaposed to form a liquid tight cover covering said boundary region and being liquid-tightly overlapped to define an overlap having a width of at least 5 millimeters between adjacent waterproof sheets, said waterproof sheets being directly attached to the outdoor tank and the foundation without any primer, wherein the pressure-sensitive adhesive layers have a bond strength of 0.5 to 10 N/25 millimeters relative to the outdoor tank and 0.5 to 10 N/25 millimeters relative to the foundation; and applying a silicone, polysulfide, or polyurethane sealant on the waterproof sheet edges adjacent to the outdoor tank, to the foundation, and to said overlaps.

* * * * *